US006857475B2

(12) United States Patent
Johnson

(10) Patent No.: US 6,857,475 B2
(45) Date of Patent: Feb. 22, 2005

(54) APPARATUS AND METHODS FOR FLOW CONTROL GRAVEL PACK

(75) Inventor: Craig David Johnson, Montgomery, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 132 days.

(21) Appl. No.: 09/973,443

(22) Filed: Oct. 9, 2001

(65) Prior Publication Data

US 2003/0066651 A1 Apr. 10, 2003

(51) Int. Cl.[7] ..... E21B 43/04; E21B 43/08

(52) U.S. Cl. ..... 166/278; 166/51; 166/235; 166/371

(58) Field of Search ..... 166/278, 369, 166/370, 371, 51, 227, 230, 235, 236

(56) References Cited

U.S. PATENT DOCUMENTS

| | | | | |
|---|---|---|---|---|
| 2,018,283 A | | 10/1935 | Schweitzer et al. | 166/21 |
| 2,083,625 A | * | 6/1937 | Harry | 166/276 |
| 2,597,554 A | | 5/1952 | West | 166/26 |
| 2,623,595 A | | 12/1952 | West | 166/1 |

(List continued on next page.)

FOREIGN PATENT DOCUMENTS

WO WO 92/08875 5/1992 ..... E21B/43/14

OTHER PUBLICATIONS

U.S. Patent Application Serial No. 09/466386, filed Dec. 17, 1999, entitled "Controlling Fluid Flow in Conduits," by Raymond J. Tibbles, James A. Pramann II, Stephen L. Jackson and David R. Mandeville.

White and Hopmann, "Controlling flow in horizontal wells," *World Oil*, pp.73–80, Nov. 1991.

Dikken, "Pressure Drop in Horizontal Wells and Its Effects on Their Production Performance," SPE 19824, pp. 561–574, 1989.

"Products: Thin Pack Screens," from http://www.johnson-screens.usfilter.com/p_thin_pack.as, printed Aug. 3, 2001.

*Primary Examiner*—David Bagnell
*Assistant Examiner*—Jennifer H Gay
(74) *Attorney, Agent, or Firm*—Williams, Morgan & Amerson P.C.; Jame A. Castano; Brigitte Jeffery Echols

(57) ABSTRACT

A wellbore completion includes a plurality of longitudinal gravel pack sections disposed within a well, the gravel pack sections being capable of imposing a predetermined substantially radial flow restriction upon fluid production flowing radially through the gravel pack section. At least one of the gravel pack sections creates a radial flow restriction that is different from the radial flow restriction of at least one other gravel pack section. The gravel pack sections may comprise graded gravel material having an effective permeability within a predetermined range when placed in the well.

23 Claims, 11 Drawing Sheets

U.S. PATENT DOCUMENTS 2,804,926 A 9/1957 Zublin ..... 166/50
3,741,300 A 6/1973 Wolff et al. ..... 166/184
4,901,796 A 2/1990 Drnevich ..... 166/278
4,995,456 A * 2/1991 Cornette et al. ..... 166/51
5,004,049 A 4/1991 Arterbury ..... 166/228
5,083,614 A * 1/1992 Branch ..... 166/278
5,107,927 A 4/1992 Whiteley et al. ..... 166/50
5,165,476 A 11/1992 Jones ..... 166/278
5,170,753 A 12/1992 Sato ..... 123/41.09
5,174,379 A 12/1992 Whiteley et al. ..... 166/278
5,269,376 A 12/1993 Gadelle et al. ..... 166/370
5,333,688 A * 8/1994 Jones et al. ..... 166/278
5,355,948 A * 10/1994 Sparlin et al. ..... 166/228
5,355,956 A * 10/1994 Restarick ..... 166/296
5,375,661 A * 12/1994 Daneshy et al. ..... 166/278
5,392,850 A * 2/1995 Cornette et al. ..... 166/51
5,435,393 A 7/1995 Brekke et al. ..... 166/370
5,551,513 A 9/1996 Surles et al. ..... 166/278
5,624,560 A 4/1997 Voll et al. ..... 210/486
5,642,781 A 7/1997 Richard ..... 166/231
5,730,223 A 3/1998 Restarick ..... 166/380
5,803,179 A 9/1998 Echols et al. ..... 166/370
5,849,188 A 12/1998 Voll et al. ..... 210/497.01
5,890,533 A 4/1999 Jones ..... 166/51
5,896,928 A 4/1999 Coon ..... 166/373
5,906,238 A 5/1999 Carmody et al. ..... 166/53
5,934,376 A * 8/1999 Nguyen et al. ..... 166/278
5,980,745 A 11/1999 Voll et al. ..... 210/497.01
6,006,829 A 12/1999 Whitlock et al. ..... 166/228
6,112,815 A 9/2000 Bøe et al. ..... 166/320
6,112,817 A 9/2000 Voll et al. ..... 166/370
6,230,801 B1 * 5/2001 Hill et al. ..... 166/278
6,318,465 B1 * 11/2001 Coon et al. ..... 166/278
2002/0125006 A1 * 9/2002 Hailey et al. ..... 166/278
2002/0125007 A1 * 9/2002 McGregor et al. ..... 166/278
2002/0157836 A1 * 10/2002 Royer et al. ..... 166/369
2002/0157837 A1 * 10/2002 Bode et al. ..... 166/373

* cited by examiner

APPARATUS AND METHODS FOR FLOW CONTROL GRAVEL PACK

BACKGROUND OF THE INVENTION

1. Field of the Invention

This invention relates generally to methods used to complete and produce hydrocarbons from subterranean wells and more particularly relates to apparatus and methods for regulating production along the length of a completed zone to optimize the production and ultimate recovery from the reservoir.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin. Horizontal wellbores are now frequently drilled within a productive formation to increase production rates and to recover greater quantities of hydrocarbons from the reservoir.

Sand or silt flowing into the wellbore from unconsolidated formations can lead to an accumulation of fill within the wellbore, reduced production rates and causing damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flow lines, valves and processing equipment. The problems caused by sand production can significantly increase operational and maintenance expenses and can lead to a total loss of the well.

One means of controlling sand production is the placement of relatively large sand (i.e., "gravel") around the exterior of a slotted, perforated, or other type liner or screen. The gravel serves as a filter to help assure that formation fines and sand do not migrate with the produced fluids into the wellbore. In a typical gravel pack completion, a screen is placed in the wellbore and positioned within the unconsolidated formation that is to be completed for production. The screen is typically connected to a tool that includes a production packer and a cross-over element, and the tool is in turn connected to a work or production tubing string. The gravel is mixed with a carrier fluid and is pumped as a slurry down the tubing and through the cross-over, thereby flowing into the annulus between the screen and the wellbore. The carrier fluid in the slurry leaks off into the formation and/or through the screen. The screen is designed to prevent the gravel in the slurry from flowing through it and entering the production tubing. As a result, the gravel is deposited in the annulus around the screen where it becomes tightly packed, forming a "gravel pack." It is important to size the gravel for proper containment of the formation sand, and the screen must be designed in a manner to prevent the flow of the gravel through the screen.

Once the well has been completed and has been put into production, excessive fluid flow rates from any production zone can cause, among other things, excessive pressure drop between the formation and the screen. Experience has shown that the inflow distribution over the length of a horizontal well is rarely uniform. A problem that is sometimes encountered, especially in long horizontal sections, is an increased fluid flow rate at certain locations along the completed interval that leads to an increased risk of premature water or gas coning at these locations. When a well is produced, the natural flow characteristics of a uniform horizontal wellbore creates a pressure differential between the reservoir and the wellbore that increases significantly in the upstream direction. This is due to pressure losses from friction and turbulent flow within the production string. As a consequence of this increase in the differential pressure, the reservoir drainage rate will increase accordingly in the upstream direction. Thus the increased drainage around the "heel" of the wellbore can lead to excessive fluid production at this location and a less than optimum production rate for the rest of the horizontal wellbore. Other factors can lead to this lack of uniformity, including: varying permeabilities; the intersection of the wellbore with natural faults and fractures; the wellbore path wandering in and out of the reservoir; thin horizontal shale barriers; varying reservoir topography; and a non-uniform hydrocarbon distribution within the reservoir. An excessive production rate at the heel and/or at other locations can result in unwanted fluids prematurely coning to this location and entering the production stream. If there is a gas-oil contact or a water-oil contact near the wellbore, breakthrough will occur first at the point where the pressure drawdown is the highest.

To alleviate these problems, various methods for controlling the flow from various sections have been developed, including the use of external packers in conjunction with sliding sleeves or rotational port collars. Mechanical inflow control devices of varying designs have also been incorporated within the sand control screens to regulate the formation production rate along the horizontal wellbore. One design induces a pressure drop across a turbulent flow control device. These devices can comprise orifice restrictions, chokes, ported nipples or pressure compensated throttling device arrangements. Another design utilizes laminar capillary-tube flow controls such as helically placed tubing around the production string to impose a longer flow path, thus inducing an increased pressure drop. Some of these designs incorporate means for controlling the imposed restrictions and therefore the pressure drop can be altered at a later time if conditions require. All of the current available designs require significant modifications to the standard sand screen apparatus typically used in horizontal gravel pack completions and typically result in complex and expensive completions.

There is a need for improved apparatus and methods to enable the regulating and/or equalizing of the flow of produced fluids within horizontal gravel pack completions.

SUMMARY OF THE INVENTION

One embodiment of the present invention is a wellbore completion comprising a plurality of longitudinal gravel pack sections disposed within a well, the gravel pack sections capable of imposing a predetermined substantially radial flow restriction upon fluid production flowing substantially radially through the gravel pack section. At least one of the gravel pack sections having a substantially radial flow restriction that is different from the substantially radial flow restriction of at least one other gravel pack section. The gravel pack sections can comprise graded gravel material having an effective permeability within a predetermined range when placed in the well.

The wellbore completion can further comprise a sand screen having a plurality of flow restricting sections capable of imposing a predetermined flow restriction upon fluid production flowing substantially radially through the sand screen sections. Each screen section can include a flow restriction element capable of imposing a restriction on the communication of fluid flow, thereby regulating the pressure profile along the sand screen length.

An alternate embodiment of the invention is a method for controlling production drainage rates within a wellbore completion comprising placing a gravel pack within a well. The gravel pack comprises a plurality of longitudinal gravel pack sections capable of imposing a flow restriction upon fluid production flowing substantially radially through the gravel pack sections. The method can further include providing a sand screen that comprises a plurality of flow restricting sections capable of imposing a flow restriction upon fluid production flowing substantially radially through the sand screen sections.

Yet another alternate embodiment is a method for completing a wellbore comprising developing a simulation completion model for the well profile that provides the desired flow restriction per well length to provide substantially equal drainage rates within the well productive length. A completion system comprising a sand screen and a gravel pack having generally the desired flow restriction per well length as determined by the simulation model is then provided.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As used herein, the terms "up" and "down"; "upper" and "lower"; "upwardly" and "downwardly"; and other like terms indicating relative positions above or below a given point or element and are used in this application to more clearly describe some embodiments of the invention. However, when applied to equipment and methods for use in wells that are deviated or horizontal, such terms may refer to positions within the horizontal plane in reference to a tool string or fluid flowpath, or other relationship as appropriate, rather than the vertical plane.

Figure 1:
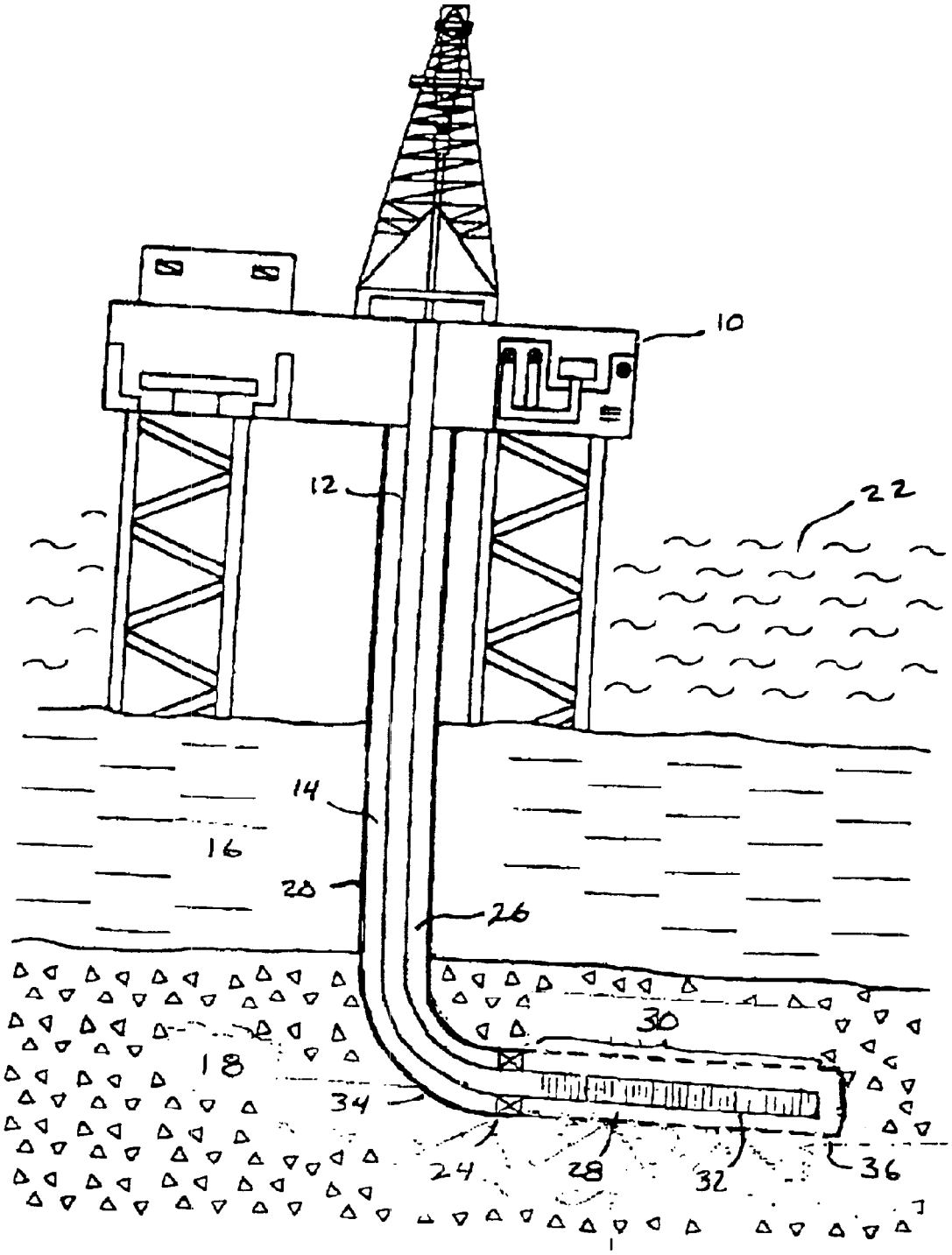
FIG. 1 is an illustration of a wellbore extending from a drilling/production platform.

Referring to the attached drawings, FIG. 1 illustrates a representative production platform 10 having a production string 12 extending into a wellbore 14. The wellbore 14 has penetrated subterranean formations 16, and intersects a productive reservoir 18. A casing string 20 lines the well and provides support and isolation of the wellbore 14 from the reservoir 18, other formations 16 and bodies of water 22. A packer 24 acts to seal the wellbore 14 and facilitates gravel packing operations. The packer 24 creates an upper annulus area 26 and a lower annulus area 28. Perforations 30 within the casing string 20 enable communication between the reservoir 18 and the production string 12. Alternatively, the wellbore 14 below the packer 24 can be competed without a casing string. The production string 12 is attached to a sand screen 32 that restricts sand production from the reservoir 18 from entering the production string 12. The lower annulus area 28 can be filled with a gravel pack sand that can act to stabilize the reservoir 18 and restrict the production of sand or fines from the reservoir 18. The area where the wellbore deviates from a vertical to a horizontal orientation can be referred to as the "heel" 34 of the well, while the distal end of the horizontal section can be referred to as the "toe" 36 of the well. The production string may have multiple production zones, may comprise a completion in a multilateral well, or comprise any other type of sand control completion used in a well. A single production zone is shown for ease of description only.

In a gravel pack operation, the packer 24 is set to ensure a seal between the production string 12 and the casing 20. Gravel laden slurry is pumped down the production string 12, exits through ports in a cross-over tool (not shown) and enters the lower annulus area 28. In one typical embodiment, the particulate matter (gravel) in the slurry has an average particle size between about 40/60 mesh-12/20 mesh, although other sizes may be used. As used herein, the term "graded gravel" can refer to compositions of homogeneous or mixed size gravel. In some embodiments of the invention, the majority of the gravel is sized within a certain range, or the gravel is comprised primarily of sand having a certain geometric shape, or the gravel comprises sand that compacts to form a gravel pack having properties such as porosity and permeability that are within a known range of values. Slurry dehydration occurs when the carrier fluid leaves the slurry. The carrier fluid can leave the slurry by way of the perforations 30 and enter the reservoir 18. The carrier fluid can also leave the slurry by way of the sand screen 32 and enter the production string 12. The carrier fluid flows up through the production string 12 until the cross-over tool places it in the upper annulus area 26 above the packer 24 where it can leave the wellbore 14 at the surface. Upon slurry dehydration the gravel grains should pack tightly together. The final gravel filled annulus area is referred to as a "gravel pack."

As used herein, the term "screen" refers to wire wrapped screens, mechanical type screens and other filtering mechanisms typically employed with sand screens. Sand screens need to be have openings small enough to restrict gravel flow, often having gaps in the 60–120 mesh range, but other sizes may be used. Screens of various types are produced by US Filter/Johnson Screen, among others, and are commonly known to those skilled in the art. As used herein, the terms "horizontal", "generally horizontal" and other similar terms refer to wells that have an orientation other than vertical in their productive zones.

Figure 2:
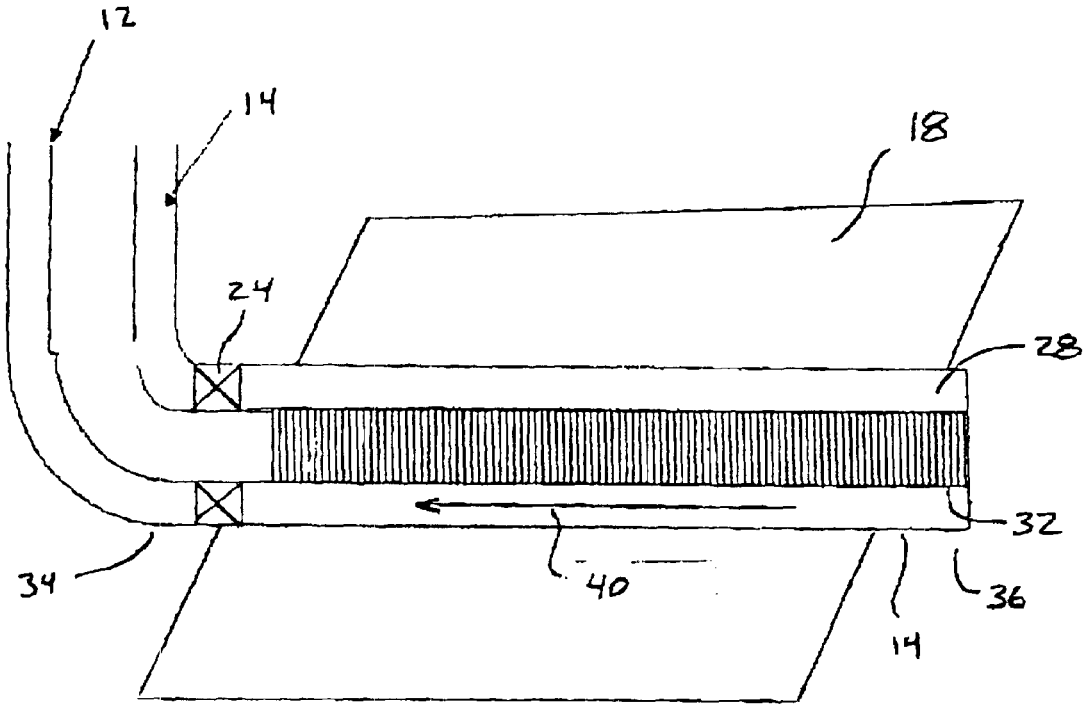
FIG. 2 is a schematic view of a cross-section of a horizontal wellbore completion.

FIG. 2 is an expanded view of the completed horizontal section shown in FIG. 1. This illustration is of a reservoir 18 having a uniform permeability throughout the completed zone. Darcy's law states that the velocity of a fluid traveling in a porous medium is proportional to the driving force (pressure differential) and the permeability of the porous medium and is inversely proportional to the fluid viscosity. When a well is produced, the natural flow characteristics of a uniform horizontal wellbore creates a pressure differential between the reservoir 18 and the interior of the sand screen 32 that increases significantly in the upstream direction 200, due to friction losses within the sand screen 32. As a consequence of this increase in the differential pressure, the reservoir 18 drainage rate will increase accordingly in the upstream direction 200. The increased drainage around the heel 34 of the wellbore can lead to excessive fluid production at this location and a less than optimum production rate for the rest of the horizontal wellbore 14 out to the toe 36.

Various aspects relating to fluid production in horizontal wells, including pressure drop analysis and its effect on well production capabilities, was the topic of a Society of Petroleum Engineers paper by B. J. Dikken in 1989. SPE paper number 19824, titled Pressure Drop in Horizontal Wells and Its Effect on Their Production Performance, investigated the fluid flow in uniform horizontal wells with a model utilizing the flow resistance and the friction within a well. This research found that for various diameter uniform horizontal wells, the ultimate well production rate increases with an increase in the wellbore diameter. This result is to be expected since larger diameter pipes experience less frictional pressure losses than smaller diameter pipes per unit of liquid transported. In all four cases investigated, the total well production rate levels off at increased lengths, and that regardless of the well length, the majority of the production is obtained within the first few hundred meters.

These findings illustrate how a uniform horizontal wellbore without any flow equalizing means can have excessive production rates at the near heel section of the completed zone, while at the same time not adequately depleting the extended lengths of the well. Without production control at the near heel area, there will be an increased tendency for water or gas coning at this location. Water or gas coning will further restrict the ultimate recovery of hydrocarbons from the entire wellbore length. Efforts to increase the production from a well by increasing the pressure drawdown within the wellbore will result in compounding the problem of excessive production at the heel and inadequate production at the toe.

To further understand the various factors involved with fluid production from horizontal wells, Schlumberger conducted modeling of horizontal wellbores in a homogeneous reservoir. The results of this wellbore modeling are graphically represented as FIGS. 3–7.

Figure 3:
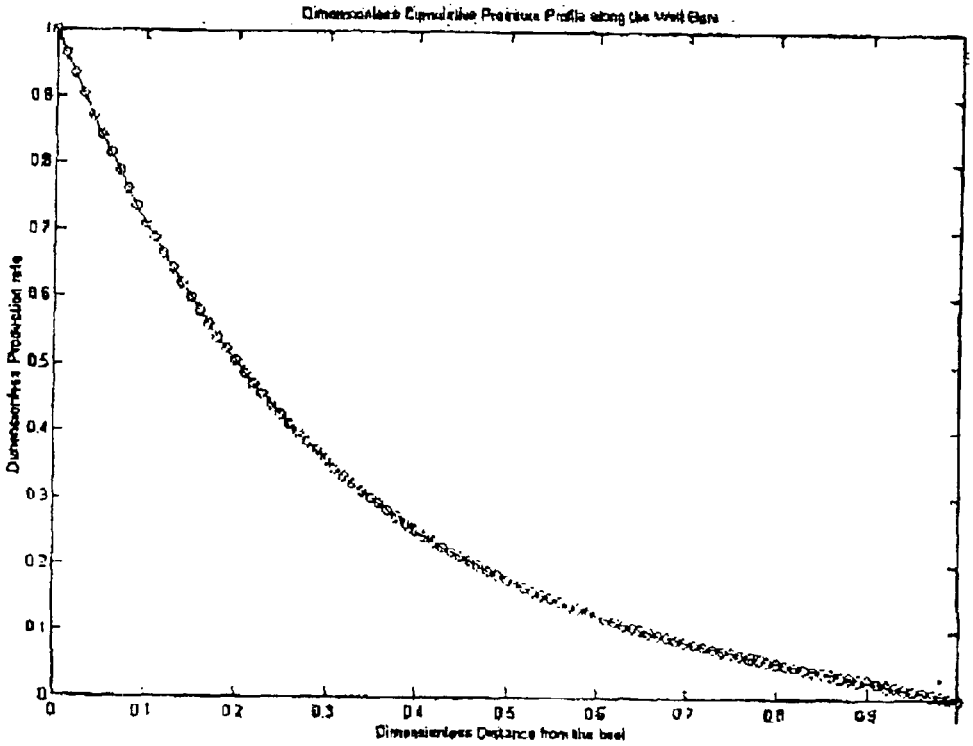
FIG. 3 is a graph of a dimensionless production rate versus a dimensionless distance from the heel.

FIG. 3 illustrates the dimensionless production rate versus a dimensionless distance from the heel. In this example, there is an exponential decrease in the production rate the greater the distance from the heel, with more than 80% of the total production being drained from less than half of the wellbore length. Since this model assumed steady state, single-phase flow, there was little sensitivity to fluid density variations. Increases in fluid viscosity resulted in more dramatic exponential profiles, where less and less of the pipe length participated in the total fluid production.

Figure 4:
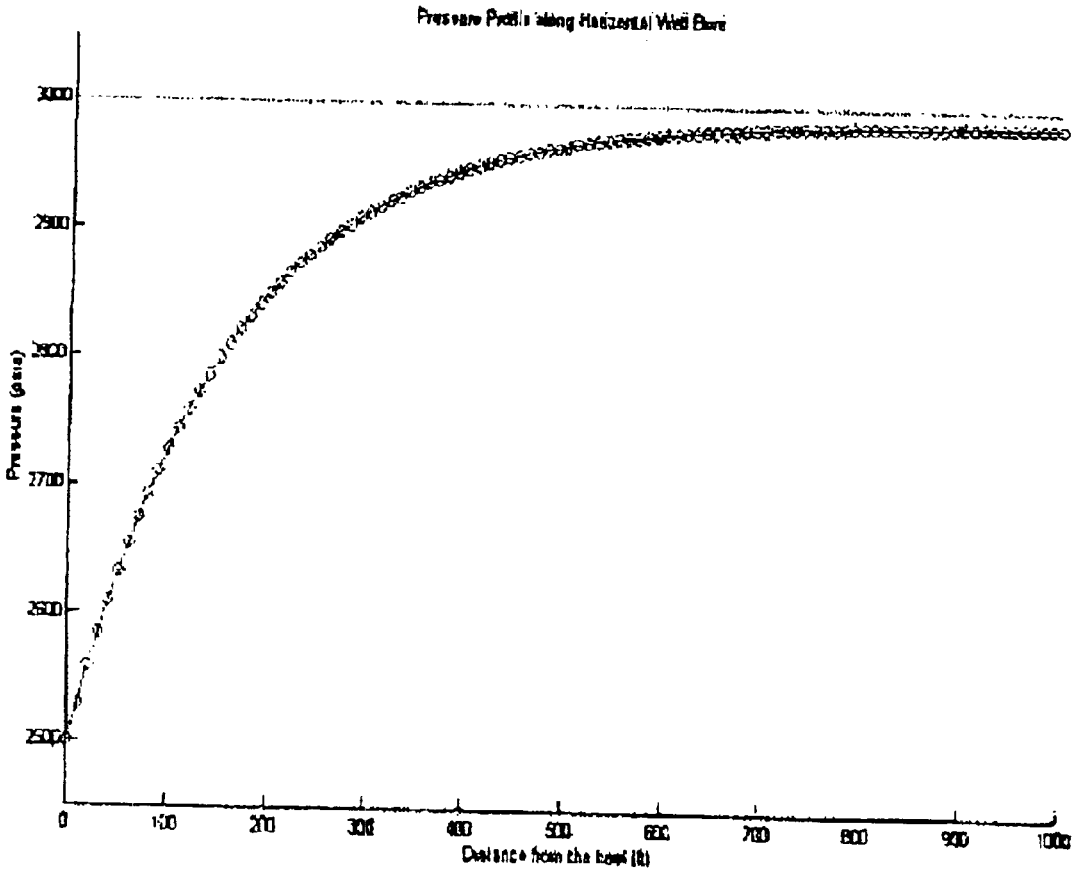
FIG. 4 is a graph of a pressure profile along the length of a horizontal wellbore.

FIG. 4 illustrates the pressure profile within the horizontal well having an exponential pressure drawdown in the near heel area, with the bulk of the pressure drop occurring within a few hundred feet of the heel. This graph illustrates that the pressure differential between the wellbore and the reservoir will vary greatly along the length of the wellbore. At the heel of the well, the pressure differential is approximately 500 psi, while at a distance of 400 feet from the heel area, the pressure differential is only 50 psi.

In addition to the differential pressure drop described above, other formation factors may contribute to the differential production at the heel of the well. Factors such as natural fracturing within the formation or varying quantities of fluid loss during drilling and completion operations can result in production differences along the wellbore length. Also, there may be a need to limit or vary the production along the length of the well other than from the toe to the heel. One example could be where the distance from the wellbore to a water-oil contact varies along the length of the wellbore. In this case, the sections of the wellbore that are nearest to the water zone may need restricted flow to avoid or delay water intrusion.

The basic idea behind the improvement of the inflow profile along the horizontal wellbore length is to slow down the radial fluid flow entry into the sand screen near the heel section of the wellbore, so as to allow more fluid to be withdrawn at the toe section of the wellbore. Since the volumetric flow rate entering the base pipe is directly proportional to the cross section of the pipe open to the flow, varying the diameter and density of the holes perforated in the base pipe can restrict the radial fluid inflow. By introducing a hole-size and/or hole-density distribution along the pipe length, an altered flow profile can be obtained. Herein the terms "substantially radial" and "radial" are used to describe the fluid flow from the reservoir into the sand screen or base pipe, fluid flow traveling through the sand screen and/or holes in the base pipe in a generally radial direction, and fluid flow through a gravel pack in a generally radial direction. The terms as used include fluid flow that is generally radial in orientation to the wellbore and sand screen, but which might also travel somewhat in the longitudinal direction, for example, the longitudinal movements of fluid flowing around the individual grains of sand comprising the gravel pack.

Figure 5:
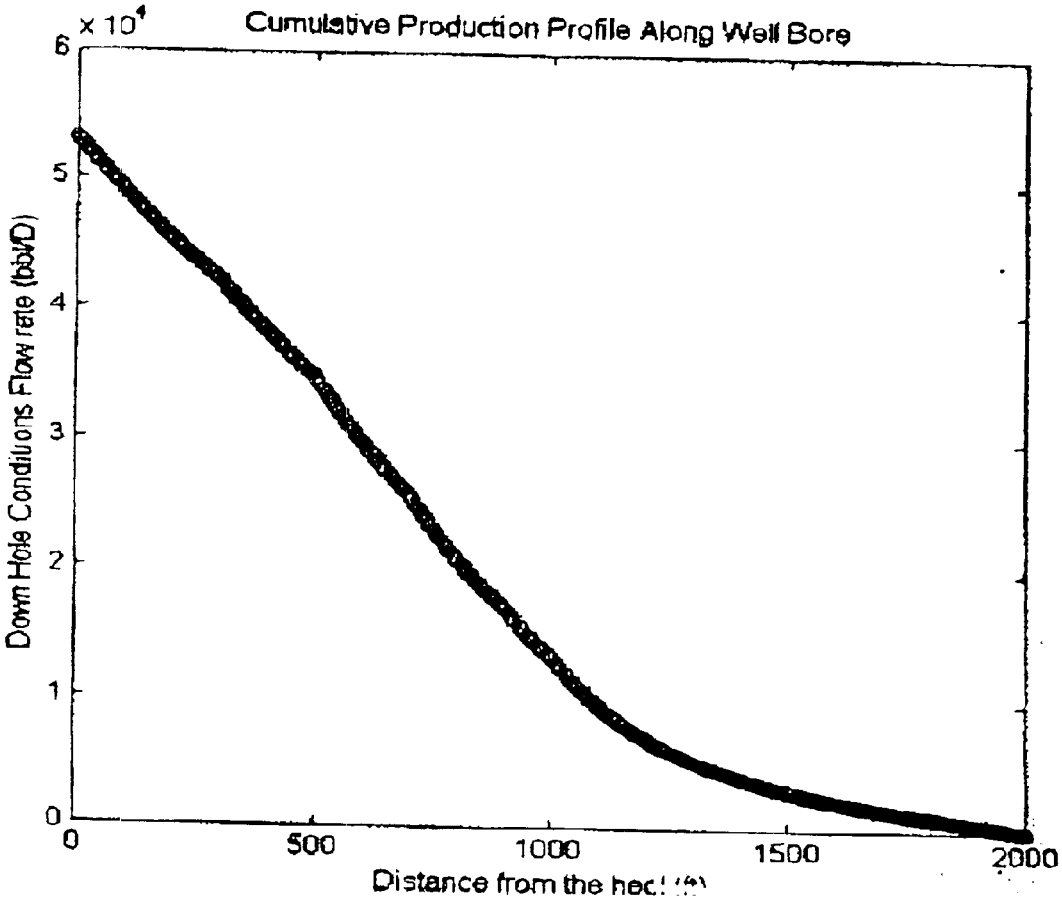
FIG. 5 is a graph of a cumulative production profile along the length of a horizontal wellbore.
Figure 6:
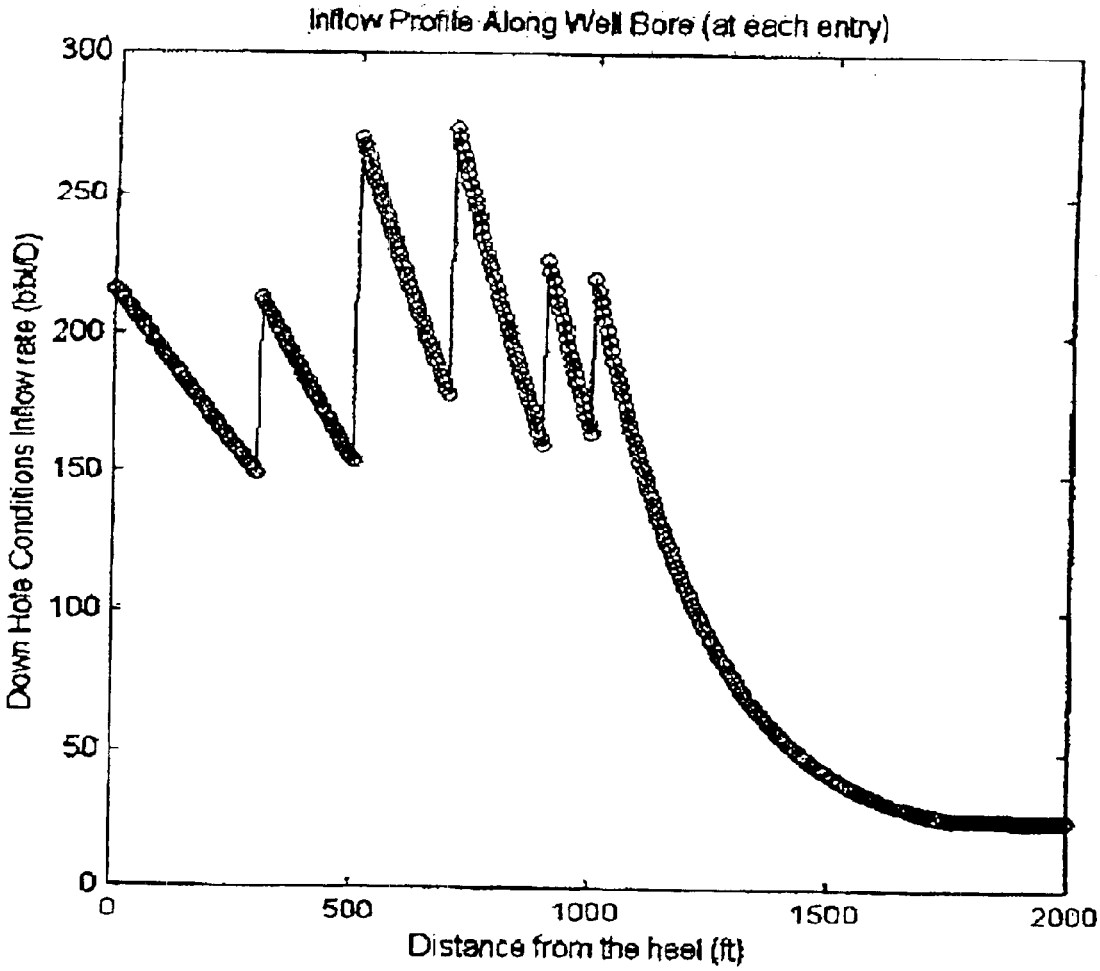
FIG. 6 is a graph of a inflow profile along the length of a horizontal wellbore.
Figure 7:
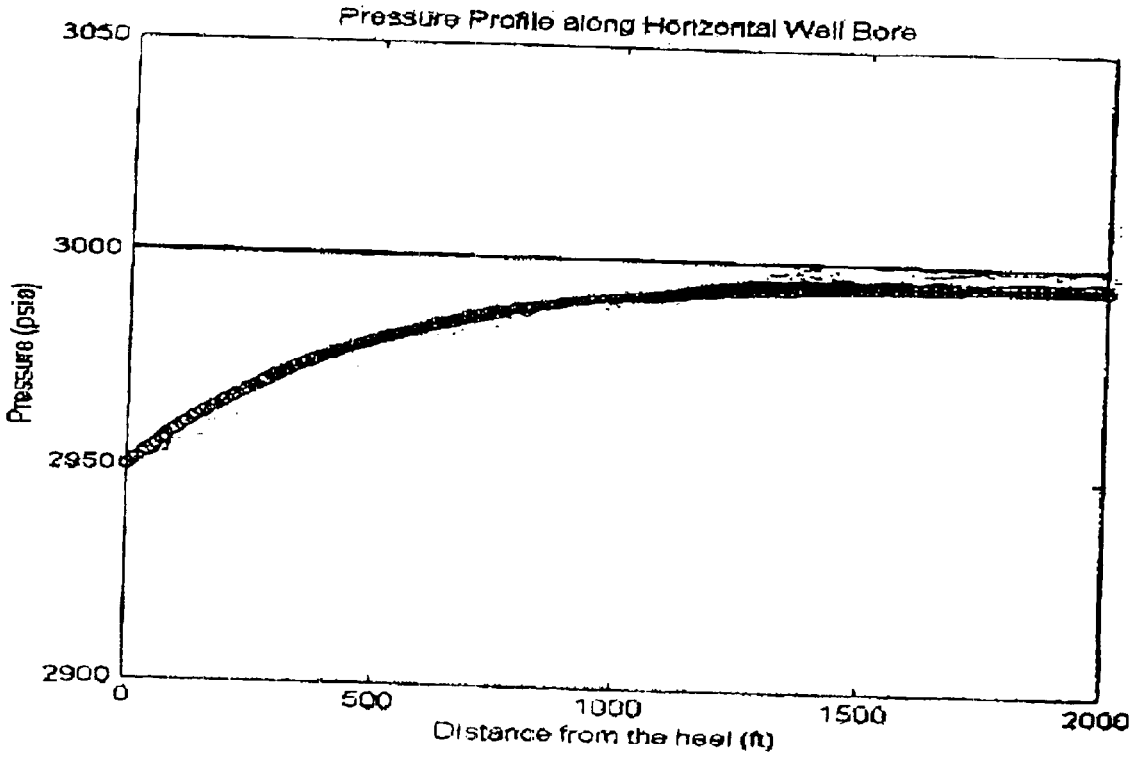
FIG. 7 is a graph of a pressure profile along the length of a horizontal wellbore.
Figure 11:
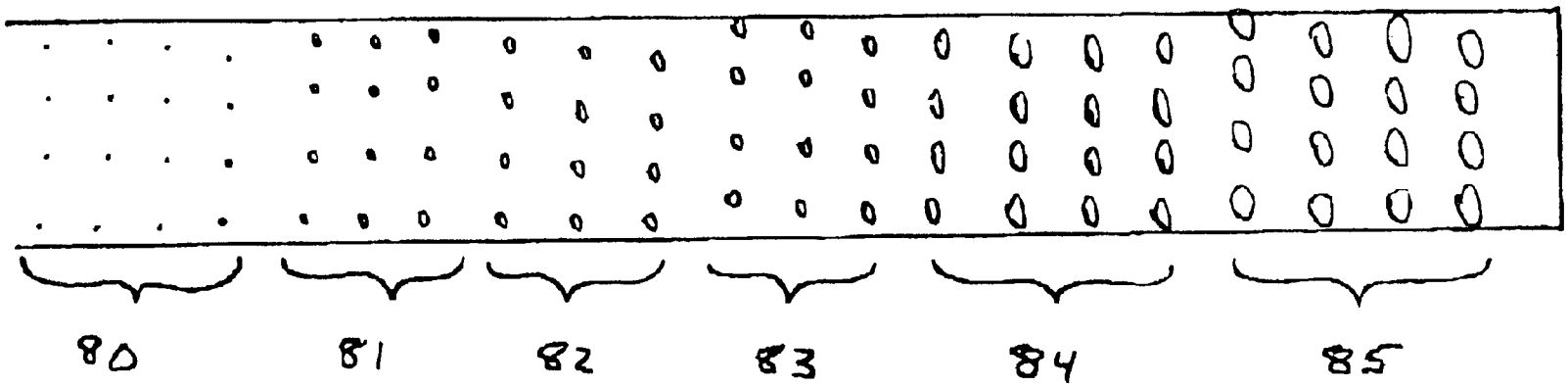
FIG. 11 is a schematic illustration of a horizontal wellbore having perforations of varying size diameter along its length.

Schlumberger performed wellbore modeling on a horizontal well having a number of sections having different size holes along the wellbore length. FIG. 11 illustrates a wellbore having six different sets of hole sizes 80–85, along the pipe length. The set having the smallest hole diameter (0.025 inch) 80 was placed near what would be the heel of the well, while progressively larger diameter hole sets were placed along the length of the pipe, with the set having the largest diameter (1.0 inch) 85 being located at the toe of the well. FIGS. 5 through 7 are graphical depictions of results of the Schlumberger wellbore modeling.

FIG. 5 shows the resulting cumulative production profile along the length of the well. The graduated flow restrictions imposed on the pipe result in a curve that is more linear and less exponential than a production profile from a zone having no flow restrictions, such as seen in FIG. 6.

FIG. 6 is the inflow profile along the length of the well that shows how each of the six sections has its own decreasing flow profile. The cumulative effect of the six sections extends the production capacity substantially further along the length of the well.

FIG. 7 shows the pressure profile along the length of the well. This model has a more linear and less exponential shaped pressure drawdown curve as compared to FIG. 4, and illustrates how the graduated hole sizes have distributed the pressure drop more evenly along the wellbore length.

Similar results in extending the pressure differential, and therefore the production profile, further along the wellbore length can be obtained by utilizing alternate means of flow restriction other than graduated hole sizes. Flow restriction through a sand screen can be obtained by utilizing screens that incorporate components that induce pressure drops in the fluids passing through them. Numerous means of inducing an elevated pressure drop across a sand screen may be used. Examples of flow restricting sand screens can include pre-packed screens, screens including mesh or filtering material and multi-passage sand control screens. Varying the permeability of the filter medium will produce a varying pressure drop along the screen or screens.

Obviously the amount of imposed pressure drop or imposed flow restriction will vary depending on factors such as how hard the well is produced. If a well is shut in with no fluid production, there will likely be no pressure drop across the screens or gravel pack, regardless of their design and characteristics. Likewise the amount of imposed pressure drop across the screens and/or gravel pack will increase in response to increased production rate, regardless of their particular design. Within the present application, the terms "known" and "predetermined" and other similar terms relating to an imposed pressure drop or flow restriction are relative terms and not meant to refer to an absolute value or a value that is fixed. For example, they can be used to compare one section of screen to another section of screen, or a section of wellbore having a gravel pack to a section of wellbore without a gravel pack. They can also be used to refer to the relative change in the wellbore characteristics when comparing a well comprising the present invention to a well that does not comprise the present invention.

Pre-packed screens, such as disclosed in U.S. Pat. No. 5,551,513 which is incorporated by reference, are well known in the industry and are commercially available by US Filters/Johnson Screens among others. They typically comprise two concentric screen jackets that define an annular space between them that is filled with a sand medium. The size and shape of the sand medium results in a known permeability through the sandpacked section.

Screens containing mesh or filtering material, such as disclosed in U.S. Pat. No. 5,849,188, incorporated by reference herein, are also known in the industry and are commercially available. The mesh material can comprise, for example, a woven wire mesh, a sintered metal filter element, or a packed mesh pad material.

A multi-passage sand control screen, such as disclosed in U.S. Pat. No. 5,642,781 and incorporated by reference herein, typically imposes circuitous flowpaths through which the produced fluid must flow. These flowpaths can be created by numerous methods, such as by having a wound helical member comprising channels and overlapping contoured edges. Flow through the helical member must take a tortuous path, which imposes additional pressure drop. The amount of pressure drop imposed is related to the length of the flow pathways and the tolerances between the overlapped edges.

Experience has shown that the productive capacity of a reservoir over the length of a horizontal well is rarely uniform. This lack of uniformity may be caused by a number of factors, including: varying permeabilities; the intersection of the wellbore with natural faults and fractures; the wellbore path wandering in and out of the reservoir; thin horizontal shale barriers; varying reservoir topography; and a non-uniform hydrocarbon distribution within the reservoir. Due to these naturally occurring variations within the reservoir, the capacity for fluid inflow to the wellbore can vary significantly along the length of the wellbore. These factors greatly complicate the well modeling beyond the homogeneous reservoir modeling discussed above.

Figure 8:
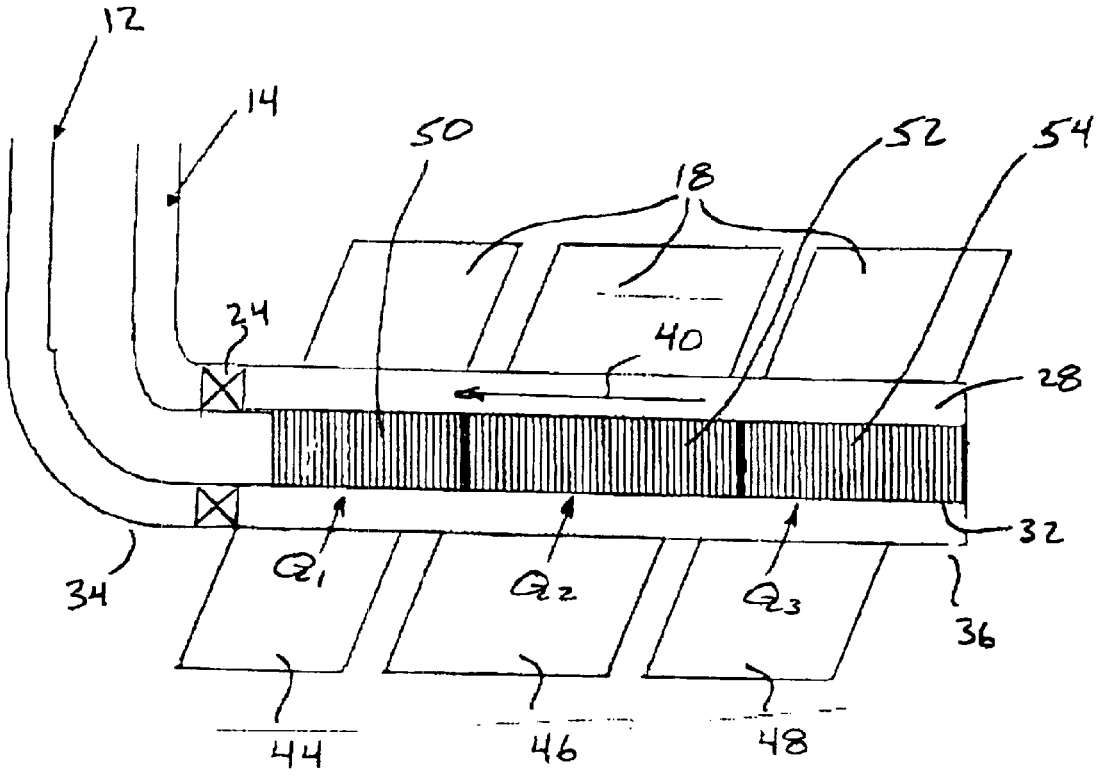
FIG. 8 is a schematic view of a cross-section of a horizontal wellbore completion comprising an embodiment of the invention.

FIG. 8 illustrates a reservoir 18 having sections of high permeability 44, 48, and a section having low permeability 46. Considering only the permeability of each section, flow rates Q1 and Q3, from the high permeability sections 44, 48 will be greater than the flow rate Q2 from the low permeability section 46. Considering only the pressure drop due to fluid flow within the sand screen 32, flow rates will increase in the upstream direction 40, resulting in the sections near the heel 34 of the well, such as section 44 having the greatest flow rate Q1. Subsequent sections progressing to the toe 36 will have progressively lower production rates. To adequately model the flow in a well such as shown in FIG. 8, the factors mentioned above, permeability and pressure drop within the flow lines, along with numerous other factors such as the reservoir pressures within the various sections, have to be considered concurrently. FIG. 8 illustrates an embodiment of the invention having sand screen sections of varying flow restriction. A first screen section 50 near the heel 34 of the well can be designed to impose a relatively large pressure drop on fluid flow through it, in an effort to restrict the drainage rate Q1 from reservoir section 44. The middle screen section 52 and the screen section 54 nearest the toe 36 of the well can be designed to impose the amount of restriction on flow rates Q2 and Q3 as needed in an effort to more equally distribute the fluid production along the completed formation. The amount of restriction desired will depend on the characteristics of reservoir sections 46 and 48 and the frictional pressure losses on flow in the upstream direction 40 within the entire sand screen 32.

Figure 9:
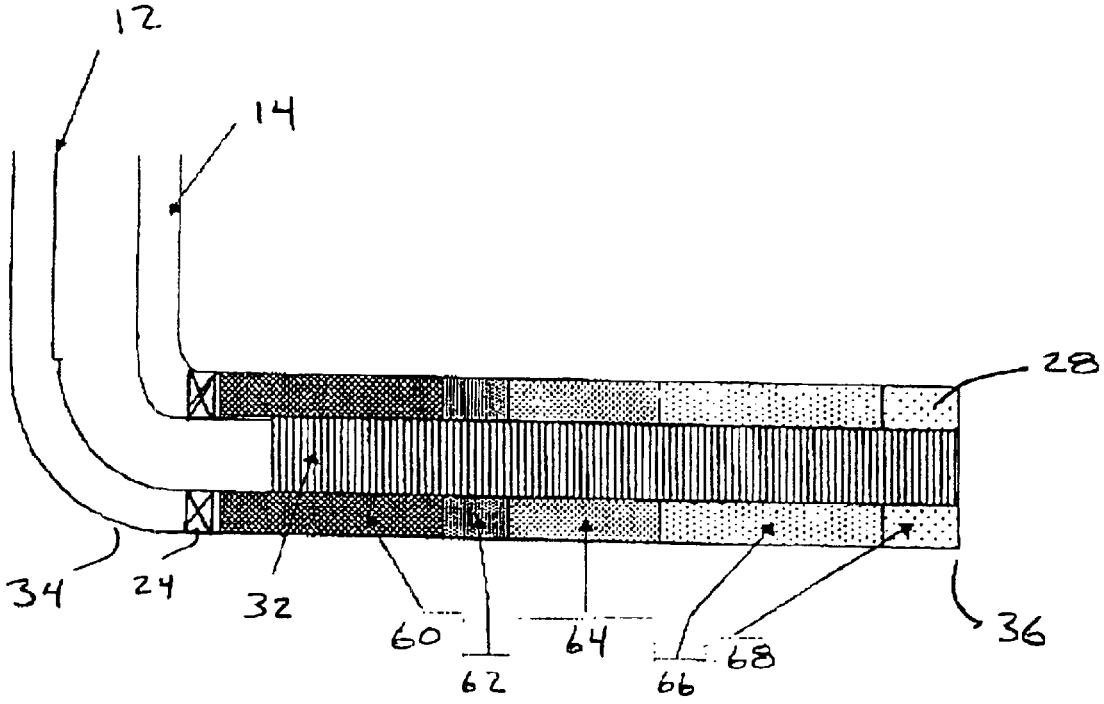
FIG. 9 is a schematic view of a cross-section of a horizontal wellbore completion comprising an embodiment of the invention.

FIG. 9 illustrates a wellbore 14 that has been completed with a gravel pack placed within the annulus area 28 between the wellbore 14 and the sand screen 32. In this example, the gravel pack has differing densities that impose a pressure restriction upon fluids flowing through them. The densities are determined according to the calculated pressure restriction that is needed to more equally distribute the fluid production along the horizontal section. Gravel pack section 60 is at the heel 34 end of the horizontal wellbore section and has highly dense packing that is capable of imposing a relatively large pressure drop upon fluid flowing through it. The density of section 62 is slightly less dense in comparison to section 60. Sections progressing towards the toe 36 are shown with progressively less dense gravel pack and therefore imposing relatively less pressure drop onto the produced fluids.

Completions as shown in FIG. 9 can be designed to compensate for increased permeability or varying zonal pressures within the reservoir. By imposing the pressure restrictions using the density of the gravel pack, the sand screen 32 may be of a standard type, thereby eliminating the need to extensively modify the screen and incur additional manufacturing and/or installation costs in some embodiments. In other embodiments both the gravel pack and the sand screen can be varied. The sections of gravel pack do not necessarily have to decrease in density as they approach the toe 36. If reservoir conditions merit, a section close to the toe 36 of the wellbore can have a gravel pack that is of greater density than a section that is closer to the heel 34. Likewise the sections of sand screen having different flow restricting elements do not have to have the greatest flow restriction at the heel 34 and progressively less restriction along the well length to the toe 36. The sand screen and gravel pack can each vary according to the requirements of the particular reservoir.

The placement of the gravel pack sections can be obtained by numerous means. In one embodiment, a standard gravel pack operation can be performed that pumps gravel of varying sizes and/or geometric shapes, depending on the resultant density that is desired. As the gravel is generally placed in the annulus beginning at the bottom and proceeding to the top, various means of placing gravel of desired size within the proper longitudinal sections are used. One means of gravel placement is performed in a two step method where a first step involves depositing gravel in a wave type pattern that fills approximately the bottom-half of the annulus, starting at the heel of the well and proceeding to the toe of the well. A second wave fills the top-half beginning from the toe and proceeding to the heel. By pumping the correct size gravel in the proper sequence the desired gravel pack can be obtained.

Mechanical elements can be incorporated within the completion design to assist in the desired placement of the various gravel pack sections. Examples of mechanical elements that can be used include burst disks, barrel valves and alternate path conduits. These elements can be used to direct the flow of various gravel laden slurry batches into the desired annular areas where the specific batches are to be placed. For example, a first batch of slurry can be directed to the annular area closest to the heel of the well. As this section packs with gravel, the slurry flowing pressure will rise until a predetermined pressure is reached. Upon reaching the predetermined pressure, a rupture disk will fail, a valve will open, or some other action will take place that will allow the next batch of slurry to proceed to a new section. The slurry can proceed down the inside of the sand screen and then exit to the annulus area or can proceed down an alternate path route that is provided within the annulus area. This pattern is then repeated as necessary to gravel pack the entire completion zone.

In one embodiment, a "one trip" completion can be performed that incorporates the perforation, gravel pack completion and possibly other treatment procedures in a single trip into the well.

Figure 10:
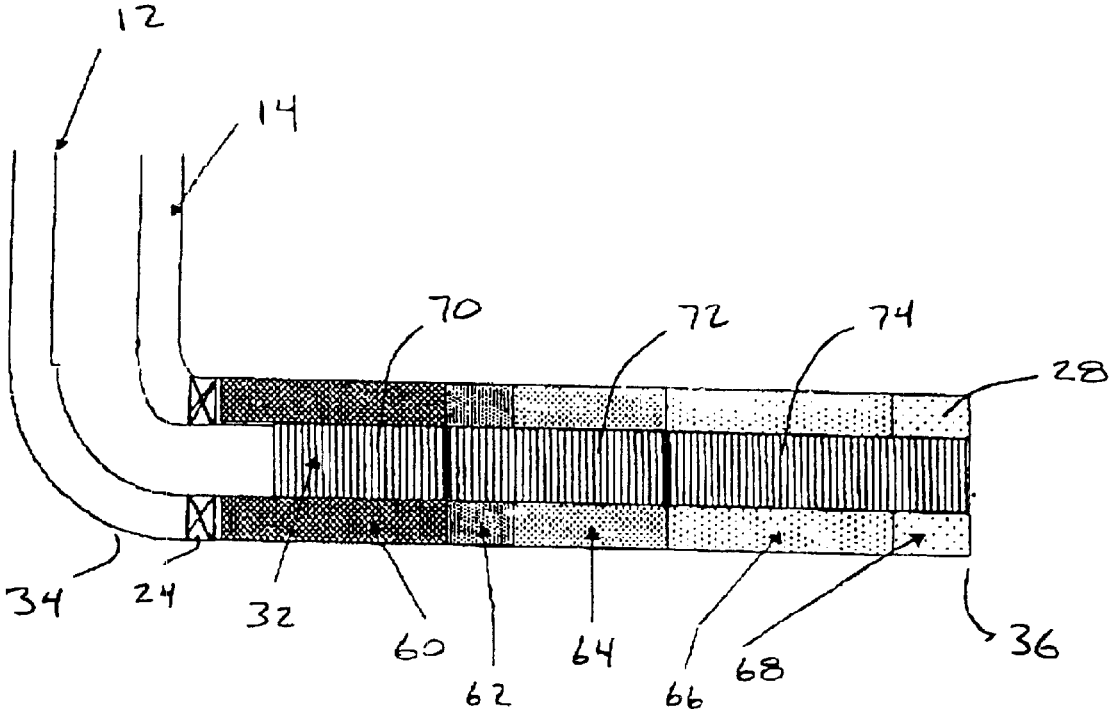
FIG. 10 is a schematic view of a cross-section of a horizontal wellbore completion comprising an embodiment of the invention.

The concept of using a sand screen having restrictive elements to modify fluid inflow rates can be used in conjunction with the concept of using a gravel pack having varying densities that also modify fluid inflow rates. The combination of the two concepts can produce a well completion system designed to optimize recovery based on the individual well characteristics. FIG. 10 shows one embodiment of the invention comprising a completion system having both a plurality of gravel pack sections 60–68 and a plurality of sand screen sections 70–74, each of these sections capable of imposing a restriction to fluid flow passing through it. The ability to vary the individual pressure drops imposed by both the screen sections and the gravel pack sections enables a more detailed well completion designed to meet the individual characteristics of the reservoir.

Once the well is drilled, reservoir conditions such as porosity, permeability, conductivity, fluid viscosities and pressures can be used to develop a reservoir completion model. The model can be used to predict production rates, pressure drawdowns, friction rates and other information for the various sections of the completed formation. The model can be utilized to design the sand screen/gravel pack completion system that would optimize production and recovery rates for the reservoir. By placing a properly designed sand screen and/or gravel pack within the well that has a varying inflow permeability, the production profile and pressure drop throughout the completed zone can be influenced to restrict the instance of zones having excessive production. By restricting production in areas having a tendency for excessive fluid flow rates, the instance of premature coning of water or gas can be reduced, thereby increasing the ultimate recovery from the well Intelligent well completions that can comprise valves within the completion assembly that are controlled from the surface can be particularly suited for use with the present invention. Valves that are actuated by utilizing pressure pulses or other signals imposed from the surface can have application in controlling and directing the flow of gravel laden slurry to the proper section of the well. One particular example involves the pumping of a first batch of gravel laden slurry into a first section. One or more valves are then actuated by signals from the surface and a second batch of gravel laden slurry is pumped into a second section. This process is then repeated as necessary.

Some of the discussion and illustrations within this application may refer to a wellbore that has casing cemented in place and comprises casing perforations to enable communication between the wellbore and the productive formation. The present invention can also be utilized to complete wells that are not cased.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A wellbore completion, comprising:

a first gravel pack section and a second gravel pack section, each gravel pack section being adapted to produce fluid therethrough and disposed within a well, the gravel pack sections capable of imposing a predetermined substantially radial flow restriction upon fluid production flowing substantially radially through the gravel pack section;

wherein the first gravel pack section imposes a substantially radial flow restriction that is different at a heel end of a horizontal wellbore from a substantially radial flow restriction at a toe end of the horizontal wellbore imposed by the second gravel pack section.

2. The wellbore completion of claim 1, wherein the gravel pack sections comprise graded gravel material having an effective permeability within a predetermined range when placed in the well.

3. The wellbore completion of claim 1, further comprising a sand screen having a plurality of flow restricting sections capable of imposing a predetermined flow restriction upon fluid production flowing substantially radially through the sand screen sections.

4. The wellbore completion of claim 3, wherein each screen section comprises a flow restriction element capable of imposing a restriction on the communication of fluid flow, thereby regulating the pressure profile along the sand screen length.

5. The apparatus of claim 4, wherein the flow restriction elements comprise one or more from the following group: sand packed sections within the screens, wire mesh within the screens, tortuous path elements within the screens and holes within a base pipe.

6. The wellbore completion of claim 1, further comprising a packer assembly attached to the sand screen.

7. The wellbore completion of claim 1, further comprising production tubing in communication with the sand screen.

8. The wellbore completion of claim 1, wherein the gravel pack sections comprise a packing of gravel having a predetermined range of fluid flow conductivities.

9. A wellbore completion, comprising:

a first gravel pack section and a second gravel pack section, each gravel pack section being adapted to produce fluid therethrough and disposed within a well, the gravel pack sections capable of imposing a predetermined substantially radial flow restriction upon fluid production flowing substantially radially through the gravel pack section;

wherein the first gravel pack section imposes a substantially radial flow restriction that is different from a substantially radial flow restriction imposed by the second gravel pack section, wherein the gravel pack sections impose a greater pressure drop at a heel end of a horizontal wellbore.

10. A wellbore completion, comprising:

a first gravel pack section and a second gravel pack section, each gravel pack section being adapted to produce thud therethrough and disposed within a well, the first gravel pack section having a different gravel density than the second gravel pack section; and wherein the first gravel pack section creates a substantially radial flow restriction upon fluid production that is different from the substantially radial flow restriction upon fluid production of the second gravel pack section along a generally horizontal well length.

11. The wellbore completion of claim 10, further comprising a sand screen having a plurality of flow restricting sections capable of imposing a predetermined flow restriction upon fluid production flowing substantially radially through the sand screen sections.

12. The wellbore completion of claim 11, wherein each screen section comprises a flow restriction element capable of imposing a restriction on the communication of fluid flow, thereby regulating the pressure profile along the sand screen length.

13. The wellbore completion of claim 11, wherein the sand screen is at least partially located within a horizontal wellbore having a heel end and a toe end.

14. A method for controlling production drainage rates within a wellbore completion, comprising:

placing a gravel pack within a well, the gravel pack comprising a first longitudinal gravel pack section and a second longitudinal gravel pack section, each of the gravel pack sections being adapted to produce fluid therethrough and being capable of imposing different flow restrictions upon fluid production flowing substantially radially through the gravel pack sections; and varying the density of a gravel pack longitudinally within a horizontal well.

15. The method of claim 14, further comprising:

providing a sand screen that comprises a plurality of flow restricting sections capable of imposing a flow restriction upon fluid production flowing substantially radially through the sand screen sections.

16. The method of claim 15, wherein the flow restriction sand screen sections comprise one or more from the group consisting of: sand packed sections within the screens, wire mesh within the screens, tortuous path elements within the screws and holes within a base pipe.

17. A method for restricting production drainage rates within a wellbore completion, comprising:

placing a gravel pack within a wellbore, the gravel pack comprising a first gravel pack section and a second gravel pack section, each of the gravel pack sections being adapted to produce fluid therethrough and having different gravel densities; and varying a substantially radial flow restriction upon fluid production along the wellbore length within a generally horizontal well.

18. The method of claim 17, further comprising:

providing a sand screen within the wellbore, wherein the sand screen comprises a plurality of sections capable of imposing flow restriction upon fluid flowing radially through the sand screen sections.

19. A method for restricting production drainage rates within a horizontal wellbore completion, comprising:

providing a sand screen having a plurality of flow restricting sections capable of imposing flow restrictions upon fluid flowing radially through the sand screen sections within the wellbore, wherein the flow restricting sections comprise one or more from the following group: sand packed sections within the screens, wire mesh within the screens, tortuous path elements within the screens and hole within a base pipe;

placing the sand screen within the wellbore, the sand screen defining an annulus area between the sand screen and the wellbore; and placing a gravel pack within the sand screen/wellbore annulus,wherein the gravel pack comprises a first gravel pack section and a second gravel pack Section being capable of production and being capable of imposing different flow restrictions at a heel end and at a toe end of a horizontal wellbore upon production fluid flowing radially through the gravel pack sections.

20. A method for completing a wellbore, comprising:

developing a simulation completion model for the well that provides a desired flow restriction per well length to provide substantially equal drainage rates within the well productive zone length; and providing a completion system comprising a sand screen and a gravel pack, the system having generally the desired flow restriction per well length as determined by the simulation completion model.

21. The method of claim 20, wherein the completion system comprises a sand screen and a gravel pack of varying densities along the wellbore length.

22. The method of claim 20, wherein the completion system comprises a conventional gravel pack and a sand screen having one or more flow restricting elements chosen from the following group: sand packed sections within the screens, wire mesh within the screens, tortuous path elements within the screens and holes within a base pipe.

23. The method of claim 20, wherein the completion system comprises flow restricting elements within the sand screen and a gravel pack of varying densities along the well length.

* * * * *